US012742244B2

(12) United States Patent
Nobukawa et al.

(10) Patent No.: US 12,742,244 B2
(45) Date of Patent: Sep. 22, 2026

(54) WATER ELECTROLYSIS CELL AND MANUFACTURING METHOD OF THE SAME

(71) Applicant: TOYOTA JIDOSHA KABUSHIKI KAISHA, Toyota (JP)

(72) Inventors: Takeshi Nobukawa, Toyota (JP); Kimihiro Tsuchiya, Fuji (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 698 days.

(21) Appl. No.: 18/062,233

(22) Filed: Dec. 6, 2022

(65) Prior Publication Data

US 2023/0243043 A1 Aug. 3, 2023

(30) Foreign Application Priority Data

Feb. 2, 2022 (JP) ..... 2022-014762

(51) Int. Cl.

| | |
|---|---|
| ***C25B 9/00*** | (2021.01) |
| ***C25B 1/04*** | (2021.01) |
| ***C25B 9/23*** | (2021.01) |
| ***C25B 11/065*** | (2021.01) |
| ***C25B 11/081*** | (2021.01) |
| ***C25B 13/04*** | (2021.01) |

(52) U.S. Cl.

CPC ..... *C25B 1/04* (2013.01); *C25B 9/23* (2021.01); *C25B 11/065* (2021.01); *C25B 11/081* (2021.01); *C25B 13/04* (2013.01)

(58) Field of Classification Search

CPC ..... C25B 1/04; C25B 11/081; C25B 11/065; C25B 9/23; C25B 13/04

See application file for complete search history.

(56) References Cited

U.S. PATENT DOCUMENTS

| | | | | |
|---|---|---|---|---|
| 6,485,855 | B1 | 11/2002 | Fukuda et al. | |
| 2003/0044672 | A1 | 3/2003 | Fukumoto et al. | |
| 2015/0001065 | A1 | 1/2015 | Vincent et al. | |
| 2018/0309135 | A1* | 10/2018 | Shimai | H01M 4/881 |
| 2019/0055657 | A1* | 2/2019 | Li | B01J 23/75 |
| 2019/0221873 | A1 | 7/2019 | Poirot-Crouvezier | |
| 2020/0240023 | A1* | 7/2020 | Cave | C25B 3/07 |

FOREIGN PATENT DOCUMENTS

| | | | |
|---|---|---|---|
| DE | 10030450 | A1 | 2/2001 |
| DE | 112004002185 | T5 | 9/2006 |
| DE | 112005000646 | T5 | 2/2007 |
| JP | 2000026986 | A | 1/2000 |
| JP | 2003168443 | A | 6/2003 |

(Continued)

*Primary Examiner* — Zulmariam Mendez

(74) *Attorney, Agent, or Firm* — Hunton Andrews Kurth LLP

(57) ABSTRACT

A water electrolysis cell includes a proton-conducting electrolyte membrane, an anode catalyst layer laminated on one face of the electrolyte membrane, and a cathode catalyst layer laminated on another face of the electrolyte membrane. At least one of the anode catalyst layer and the cathode catalyst layer includes, in an in-plane direction of the anode catalyst layer and the cathode catalyst layer, a portion with a high density of catalyst and a portion with a lower density of the catalyst than the portion with a high density.

1 Claim, 4 Drawing Sheets

(56) References Cited

FOREIGN PATENT DOCUMENTS

| | | | |
|---|---|---|---|
| JP | 2004360076 | A | 12/2004 |
| JP | 2015506414 | A | 3/2015 |
| JP | 2019179759 | A | 10/2019 |
| KR | 20210066986 | A | 6/2021 |
| WO | 2005048382 | A2 | 5/2005 |
| WO | 2005099001 | A1 | 10/2005 |
| WO | 2017047121 | A1 | 3/2017 |

* cited by examiner

WATER ELECTROLYSIS CELL AND MANUFACTURING METHOD OF THE SAME

CROSS-REFERENCE TO RELATED APPLICATION

This application claims priority to Japanese Patent Application No. 2022-014762 filed on Feb. 2, 2022, incorporated herein by reference in its entirety.

BACKGROUND

1. Technical Field

The present disclosure relates to a water electrolysis cell used for water electrolysis, and to a manufacturing method of the same.

2. Description of Related Art

Japanese Unexamined Patent Application Publication No. 2004-360076 (JP 2004-360076 A) discloses a method for manufacturing an electrode. In this method for manufacturing an electrode, an electrode is obtained in which a distribution state of solid polymer electrolyte and so forth in an electrode catalyst layer is adjusted. Specifically, this method for manufacturing an electrode includes a process of applying and drying an ink in which a catalyst and an electrolyte component are mixed, on a sheet member, a process of repeating this process twice to prepare two layers, and a process of transferring the two layers onto an electrolyte membrane.

Japanese Unexamined Patent Application Publication (Translation of PCT Application) No. 2015-506414 (JP 2015-506414 A) discloses a method for manufacturing a catalyst electrode. In this method for manufacturing a catalyst electrode, the electrode is manufactured by depositing and solidifying a catalyst ink upon a support member, and thereafter performing joining thereof to an electrolyte membrane.

Japanese Unexamined Patent Application Publication No. 2000-26986 (JP 2000-26986 A) discloses water electrolysis using a solid electrolyte type water electrolysis device. The solid electrolyte type water electrolysis device has an electrolysis cell 1. Platinum group metal is plated on both sides of a solid electrolyte membrane 2 of the electrolysis cell 1. Porous power feeders 3 are disposed on the plating layers on both sides of the solid electrolyte membrane 2. Electrode plates 4 are disposed on the outside of each porous feeders 3. In the solid electrolyte type water electrolysis device, iridium (Ir) or ruthenium (Ru) is used as the platinum group metal, and water electrolysis is performed at 60° C. to 120° C.

SUMMARY

In water electrolysis, quickly discharging generated gas from the water electrolysis cell is important. In the related art, oxygen gas bubbles generated by water electrolysis adhere to and stay on the surface of catalyst active sites until grown to a certain size. Water electrolysis performance is deteriorated as long as the oxygen gas bubbles remain on surfaces of the catalyst active sites. Accordingly, in the related art, there are cases in which the number of apparent catalyst active sites that can be used for water electrolysis decreases, resulting in deterioration in water electrolysis performance.

The present disclosure promotes the discharge of generated gas to enhance water electrolysis efficiency.

A water electrolysis cell according to an aspect of the present disclosure includes a proton-conducting electrolyte membrane, an anode catalyst layer laminated on one face of the electrolyte membrane, and a cathode catalyst layer laminated on another face of the electrolyte membrane. At least one of the anode catalyst layer and the cathode catalyst layer includes, in an in-plane direction of the anode catalyst layer and the cathode catalyst layer, a portion with a high density of catalyst and a portion with a lower density of the catalyst than the portion with a high density.

In the above water electrolysis cell, a density of the catalyst in the portion with a high density of the catalyst may be higher than that in the portion with a lower density of the catalyst by 1.1 times or more.

In the above water electrolysis cell, the catalyst of the anode catalyst layer may contain iridium oxide.

In the above water electrolysis cell, the catalyst of the cathode catalyst layer may contain platinum-on-carbon and an ionomer.

A water electrolysis cell according to an aspect of the present disclosure includes a proton-conducting electrolyte membrane, an anode catalyst layer laminated on one face of the electrolyte membrane, and a cathode catalyst layer laminated on another face of the electrolyte membrane. The anode catalyst layer includes, in an in-plane direction of the anode catalyst layer, a portion with a high density of catalyst and a portion with a lower density of the catalyst than the portion with a high density.

A method for manufacturing a water electrolysis cell according to an aspect of the present disclosure includes placing a backing sheet on a fixing table provided with a plurality of holes, forming concave portions on a surface of the backing sheet that are recessed into the holes, by suctioning the backing sheet through the holes, applying a catalyst ink to the surface of the backing sheet to obtain a layer of the catalyst ink including convex portions made at positions of the concave portions, and sandwiching the layer between smooth plates and applying heat and pressure such that an anode catalyst layer is obtained in which portions at which the convex portions are compressed become portions exhibiting a higher density of catalyst than other portions.

In the water electrolysis cell according to the present disclosure, the catalyst layer has high density portions and a low density portion of the catalyst in the direction of water flowing. Gas bubbles generated in high density portions gather more than the surroundings and grow larger quickly, which promotes desorption from the catalyst surface, and the desorbed bubbles incorporate bubbles on the catalyst surface in a low density portion, thereby promoting recovery of catalyst active sites. As a result, the number of apparent active sites during the reaction increases, and the water electrolysis performance improves.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

1. Configuration of Water Electrolysis Cell

Figure 1:
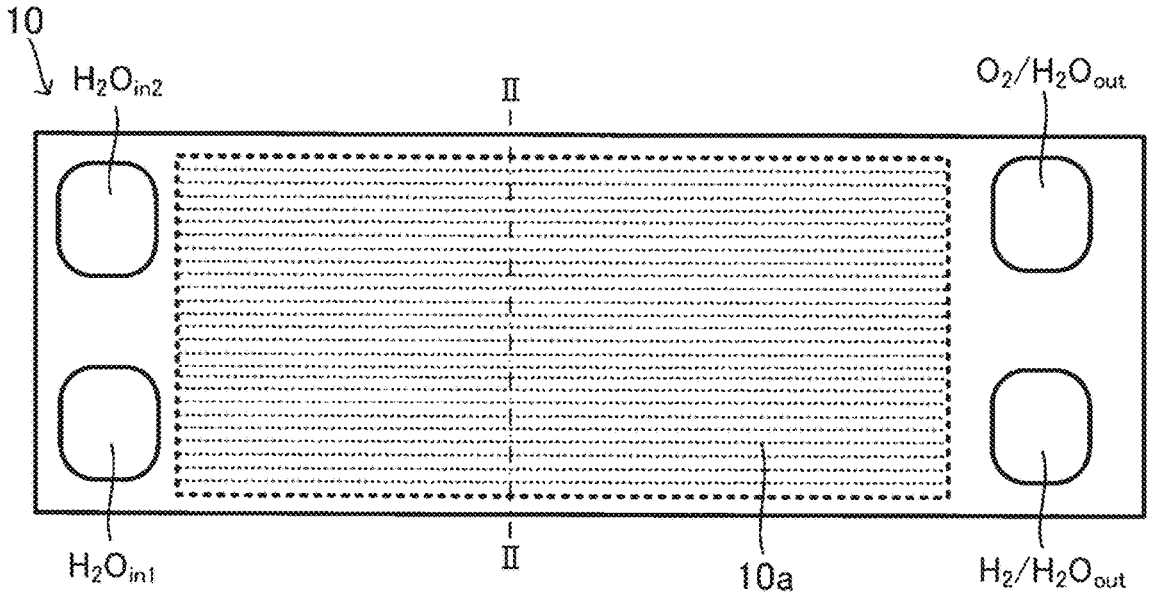
FIG. 1 is a plan view of a water electrolysis cell 10.
Figure 2:
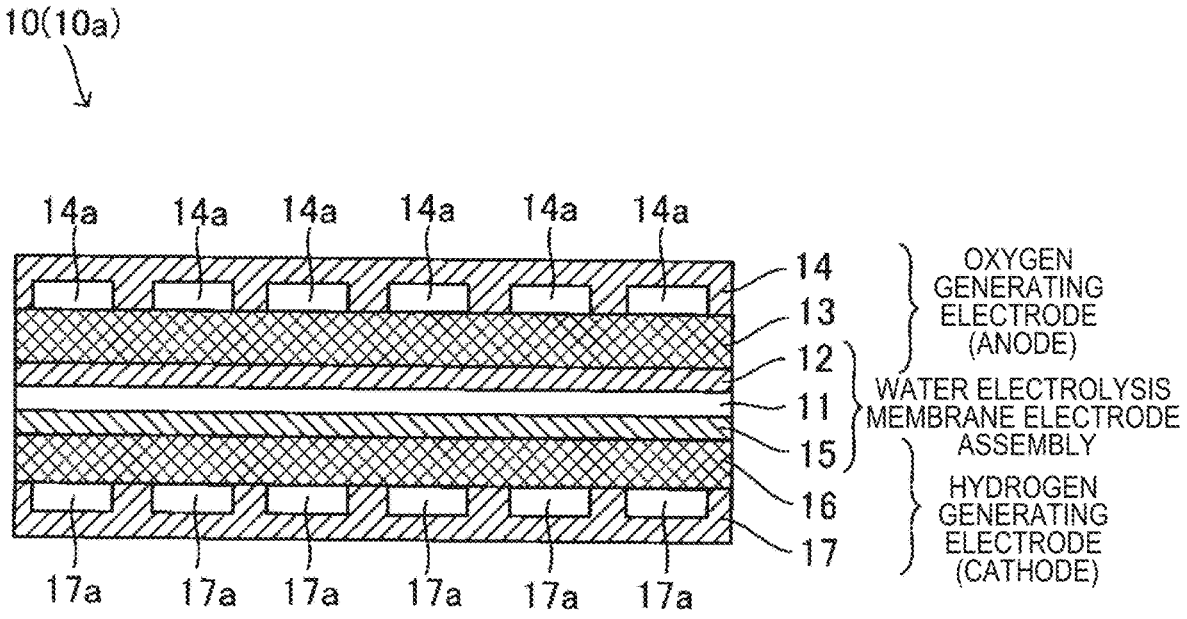
FIG. 2 is a conceptual diagram illustrating a layer structure in a water electrolysis unit 10*a* of the water electrolysis cell 10.

FIGS. 1 and 2 are diagrams illustrating a water electrolysis cell 10 according to an embodiment. The water electrolysis cell 10 is a unit element for decomposing pure water into hydrogen and oxygen. A plurality of such water electrolysis cells 10 is stacked together to form a water electrolysis stack. FIG. 1 is a plan view of the water electrolysis cell 10. FIG. 2 is a partial cross-sectional view taken along line II-II in FIG. 1. FIG. 2 is a diagram illustrating a layer configuration of a water electrolysis unit 10*a*, which is the portion of the water electrolysis cell 10 at which water electrolysis is performed.

The water electrolysis cell 10 is made up of a plurality of layers, one of which serves as an oxygen generating electrode (anode), and another serves as a hydrogen generating electrode (cathode), with a solid polymer electrolyte membrane 11 interposed therebetween. The anode includes an anode catalyst layer 12, an anode gas diffusion layer 13, and an anode separator 14, laminated in this order from the solid polymer electrolyte membrane 11 side. On the other hand, the cathode includes a cathode catalyst layer 15, a cathode gas diffusion layer 16, and a cathode separator 17, in this order from the solid polymer electrolyte membrane 11 side. Here, a water electrolysis membrane electrode assembly is a laminate of the solid polymer electrolyte membrane 11, the anode catalyst layer 12 disposed on the anode side of the solid polymer electrolyte membrane 11, and the cathode catalyst layer 15 disposed on the cathode side of the solid polymer electrolyte membrane 11. A typical thickness of the water electrolysis membrane electrode assembly is around 0.4 mm. A typical thickness of the water electrolysis cell 10 at the water electrolysis unit 10*a* is around 1.3 mm. Each layer is as follows, for example.

1.1. Solid Polymer Electrolyte Membrane

The solid polymer electrolyte membrane 11 is one form of a membrane having proton conductivity. The material (electrolyte) making up the solid polymer electrolyte membrane 11 in the present embodiment is a solid polymer material, examples of which include a proton conductive ion exchange membrane made of a fluororesin, a hydrocarbon resin material, and so forth. This exhibits good proton conductivity (electrical conductivity) under wet conditions. A more specific example is a membrane made of Nafion (registered trademark), which is a perfluoro-based electrolyte. Although not limited in particular, the thickness of the solid polymer electrolyte membrane 11 may be 100 μm or less, preferably 50 μm or less, more preferably 30 μm or less.

1.2. Anode Catalyst Layer

The anode catalyst layer (oxygen electrode catalyst layer) 12 is a layer having a catalyst containing at least one of noble metal catalysts such as platinum (Pt), ruthenium (Ru), iridium (Ir), and so forth, and oxides thereof. More specifically, examples of the catalyst include platinum, iridium oxides, ruthenium oxides, iridium ruthenium oxides, and mixtures thereof. Examples of iridium oxides include iridium oxide ($IrO_2$, $IrO_3$), iridium tin oxides, iridium zirconium oxides, and so forth. Examples of ruthenium oxides include ruthenium oxide ($RuO_2$, $Ru_2O_3$), ruthenium tantalum oxides, ruthenium zirconium oxides, ruthenium titanium oxides, ruthenium titanium cerium oxides, and so forth. Examples of iridium ruthenium oxides include iridium ruthenium cobalt oxides, iridium ruthenium tin oxides, iridium ruthenium iron oxides, iridium ruthenium nickel oxides, and so forth.

The anode catalyst layer 12 here may contain an ionomer. Containing the ionomer enables coatability to be improved, and further the hydrophilicity of the ionomer can facilitate permeation of water supplied at the time of water decomposition. Examples of the ionomer contained in the anode catalyst layer 12 include an ionomer containing a perfluoro-based electrolyte, which is an electrolyte used in solid polymer electrolyte membranes.

Figure 3:
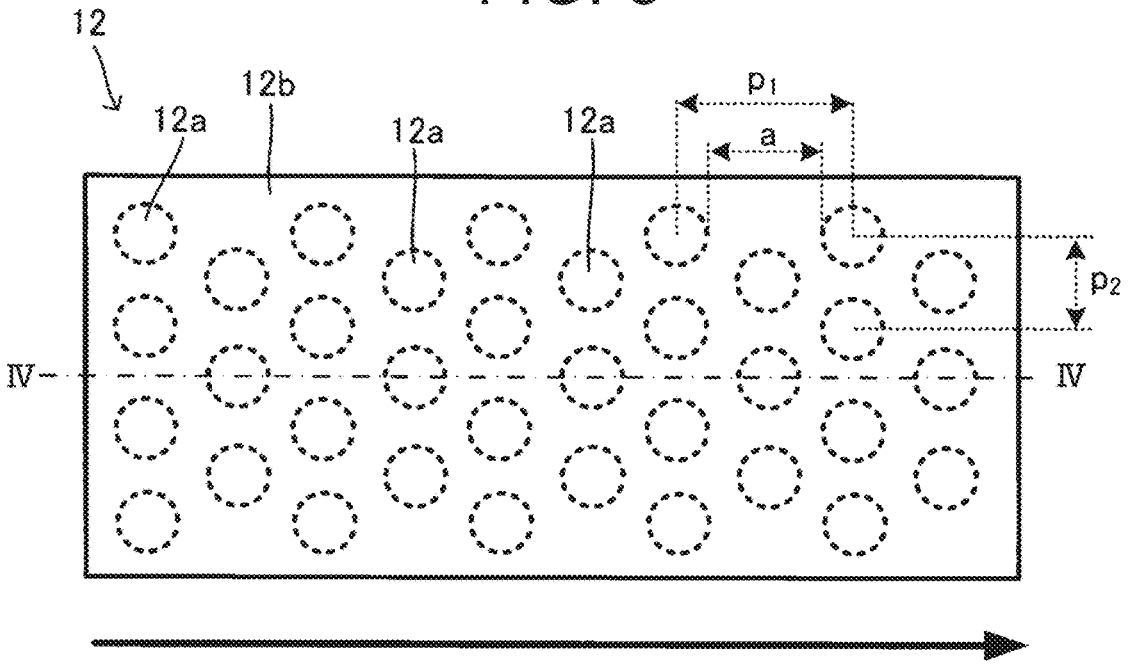
FIG. 3 is a plan view illustrating an anode catalyst layer 12.
Figure 4:
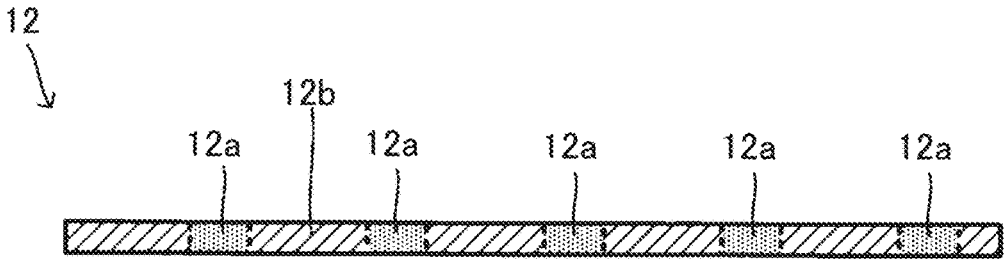
FIG. 4 is a sectional view illustrating the anode catalyst layer 12.

Further, in the present embodiment, the anode catalyst layer 12 has a distribution of high and low catalyst densities in a layer plane direction thereof. FIGS. 3 and 4 are diagrams for description thereof. FIG. 3 is a plan view of the anode catalyst layer 12, illustrating a layer face of the anode catalyst layer 12. FIG. 4 is a sectional view taken along line IV-IV in FIG. 3, illustrating a section of the anode catalyst layer 12 in a thickness direction.

The anode catalyst layer 12 according to the present embodiment contains a catalyst such as described above, with portions having high catalyst density (high density portions) distributed in the layer plane direction. For example, in the examples illustrated in FIGS. 3 and 4, high density portions 12*a*, which are portions denoted by the sign 12*a*, are distributed in the layer plane direction of the anode catalyst layer 12. The high density portions 12*a* are portions surrounded by dotted lines in FIG. 3. In FIG. 3, only a portion of the high density portions are indicated by the sign 12*a*, to reduce repetition. The portion denoted by sign 12*b* is a portion (low density portion 12*b*) having a lower catalyst density than that of the high density portions 12*a*. Also, the high density portion 12*a* is preferably provided over the entire thickness direction of the anode catalyst layer 12.

The difference between the density of the catalyst in the high density portions 12*a* and the density of the catalyst in the low density portion 12*b* is sufficient as long as the density of the catalyst in the high density portions 12*a* is higher than the density of the catalyst in the low density portion 12*b*. It is sufficient for the density of the catalyst in the high density portions 12*a* to be greater than 1.0 times the density of the catalyst in the low density portion 12*b*. From the viewpoint of obtaining even higher effects, the density of the catalyst in the high density portions 12*a* is preferably 1.1 times or more the density of the catalyst of the low density portion 12*b*, and more preferably, 1.2 times or more. On the other hand, while the upper limit thereof is not limited in particular, the upper limit is preferably no greater than 2 times, from the viewpoint of ensuring the fluidity of water and gas.

The distribution of the high density portions 12*a* in the layer plane direction is not limited in particular, but proportion of the area of the high density portions 12*a* as to the area of the anode catalyst layer 12 from the viewpoint in FIG. 3 is preferably 5% or more and 80% or less. When lower than this range, the effects of the high density portions 12*a* may be smaller. On the other hand, when higher than this range, fluidity of water and generated oxygen gas may be hindered.

The proportion more preferably is 10% or more and 60% or less, and even more preferably is 15% or more and 40% or less.

Although not limited in particular, the layout of the high density portions 12*a* are preferably laid out over the entire anode catalyst layer 12. In such a layout, the high density portions 12*a* adjacent to each other in a flow direction are preferably offset in a width direction (direction orthogonal to the flow direction), i.e., a staggered layout, as illustrated in FIG. 3.

The shape of each high density portion 12*a* is not limited in particular, and may be circular in plan view as in the present embodiment. The shape of each high density portion 12*a* may be triangular, quadrangular, or some other polygon, elliptical, fan-shaped, or irregular. Also, the size of each high density portion 12*a* is not limited in particular. For example, when each high density portion 12*a* is circular in plan view, the diameter can be about 5 mm to 30 mm. For example, when each high density portion 12*a* is other than circular in plan view, the area in plan view can be around 19 $mm^2$ to 710 $mm^2$.

1.3. Cathode Catalyst Layer

A known catalyst can be used as the catalyst contained in the cathode catalyst layer 15, and examples thereof include platinum, platinum-coated titanium, platinum-on-carbon, palladium-on-carbon, cobalt glyoxime, nickel glyoxime, and so forth. The cathode catalyst layer 15 here may contain an ionomer. Coatability can be improved by containing an ionomer. Examples of the ionomer contained in the cathode catalyst layer 15 include an ionomer made of a perfluoro-based electrolyte, which is an electrolyte used in solid polymer electrolyte membranes.

Note that the cathode catalyst layer 15 may also have portions corresponding to the high density portions 12*a* and the low density portion 12*b* described with respect to the anode catalyst layer 12. According to this, the same effects as described below can be obtained in the generation and discharge of hydrogen gas.

1.4. Anode Gas Diffusion Layer

A known member can be used for the anode gas diffusion layer 13, which is made up of a member having gas permeability and electroconductivity. Specific examples include porous electroconductive members and so forth, made of sintered compacts of metal fibers (e.g., titanium fibers) or metal particles (titanium particles) or the like.

1.5. Cathode Gas Diffusion Layer

A known member can be used for the cathode gas diffusion layer 16, which is made up of a member having gas permeability and electroconductivity. Specific examples include porous members such as carbon cloth, carbon paper, and so forth.

1.6. Anode Separator

A known member can be used for the anode separator 14, which is a member provided with channels (grooves) 14*a* through which pure water is supplied to the anode gas diffusion layer 13, and through which the generated oxygen flows. As can be seen from FIG. 1, the anode separator 14 has a water inlet port $H_2O_{in1}$ and a water inlet port $H_2O_{in2}$ provided at positions on the outer side of the water electrolysis unit 10*a* and at portions on a first end portion side of the channels 14*a* (FIG. 2), and a water and oxygen outlet port $O_2/H_2O_{out}$ and a water and hydrogen outlet port $H_2/H_2O_{out}$ provided at portions on a second end portion side of the channels 14*a*. Now, the channels 14*a* communicate with the water inlet port $H_2O_{in1}$ at the first end portions thereof, and with the water and oxygen outlet port $O_2/H_2O_{out}$ at the second end portions thereof.

1.7. Cathode Separator

A known member can be used for the cathode separator 17, which is a member provided with channels (grooves) 17*a* through which separated hydrogen and accompanying water flow. As can be seen from FIG. 1, the cathode separator 17 has the water inlet port $H_2O_{in1}$ and the water inlet port $H_2O_{in2}$ provided at positions on the outer side of the water electrolysis unit 10*a* and at portions on a first end portion side of the channels 17*a* (FIG. 2), and the water and oxygen outlet port $O_2/H_2O_{out}$ and the water and hydrogen outlet port $H_2/H_2O_{out}$ provided at portions on a second end portion side of the channels 17*a*. Now, the channels 17*a* communicate with the water inlet hole $H_2O_{in2}$ at the first end portions thereof, and with the water and hydrogen outlet hole $H_2/H_2O_{out}$ at the second end portions thereof.

1.8. Generation of Hydrogen by Water Electrolysis Cell, Effects, etc.

The water electrolysis cell 10 described above generates hydrogen and oxygen from pure water as follows. Accordingly, the water electrolysis cells and water electrolysis stack according to the present disclosure can be provided with known members and configurations necessary for generating hydrogen, in addition to the above. Pure water ($H_2O$) is supplied from the channels 14*a* of the anode separator 14 to the anode (oxygen generating electrode). Applying electricity across the anode and the cathode decomposes the pure water into oxygen, electrons, and protons ($H^+$) at the anode catalyst layer 12 to which potential is applied. At this time, the protons travel through the solid polymer electrolyte membrane 11 to the cathode catalyst layer 15. On the other hand, the electrons separated at the anode catalyst layer 12 reach the cathode catalyst layer 15 through an external circuit. The protons then receive the electrons at the cathode catalyst layer 15, to generate hydrogen ($H_2$). The generated hydrogen reaches the cathode separator 17 and is discharged through the channels 17*a*. Note that the oxygen separated at the anode catalyst layer 12 reaches the anode separator 14 and is discharged through the channels 14*a*.

Focusing on the anode catalyst layer 12 in the generation of hydrogen and oxygen, water is supplied to the anode catalyst layer 12 from the channels 14*a* of the anode separator 14 via the anode gas diffusion layer 13. Water flows overall from the water inlet port $H_2O_{in1}$ toward the water and oxygen outlet port $O_2/H_2O_{out}$ illustrated in FIG. 1, and accordingly the water and the generated oxygen gas flows overall in the direction of a straight arrow in FIG. 3 at the anode catalyst layer 12 as well. The decomposition of water then occurs due to the catalyst of the anode catalyst layer 12, and oxygen gas is generated, thereby generating oxygen bubbles. Now, the high density portions 12*a* having a high catalyst density are provided in the present embodiment. More oxygen gas generated by water electrolysis gathers at the high density portions 12*a*, and the bubbles desorb from the catalyst surface (catalyst active sites) faster than at portions other than the high density portions 12*a*. Thus, the oxygen bubbles that desorb quicker than the surroundings diffuse to the low density portion 12*b* along with the flow of water, and it is thought that these bubbles come into contact with oxygen bubbles retained on the catalyst surface of the low density portion 12*b*, and remove the oxygen from the catalyst surface. As a result, desorption of oxygen bubbles from the catalyst can be promoted not only in the high density portions 12*a*, but in the low density portion 12*b* as well. Accordingly, oxygen can be generated (decomposition of water) at a high frequency at the catalyst. As a result, high electrolysis performance can be maintained in long-term water electrolysis operations.

In the related art, the concentration of the catalyst is uniform in the direction of flow of water, and accordingly there are cases in which desorption of the generated oxygen gas from the catalyst cannot be actively promoted. Also, when there is a difference in the density of the catalyst in the thickness direction of the anode catalyst layer, or when the catalyst is made highly dense overall, gaps between the high density parts are small, so the diffusion and fluidity of the water serving as an ingredient may be hindered. That is to say, the anode catalyst layer 12 according to the present embodiment has difference in the density of the catalyst along the direction in which water flows. Accordingly, the above-described action of the oxygen gas generated in the high density portions of the catalyst can promote desorption of bubbles from the catalyst over the entire anode catalyst layer, while promoting the diffusion of water in the low density portion of the catalyst.

2. Manufacturing Method

The water electrolysis cell 10 as described above can be manufactured as follows, for example.

2.1. Preparation of Anode Catalyst Layer

The high density portions 12*a* and the low density portion 12*b* of the catalyst coexist in the anode catalyst layer 12, as described above, and such a form can be prepared as follows, for example.

First, a catalyst ink 22 is obtained by mixing an anode catalyst, an ionomer, deionized water, and alcohol.

Figure 5:
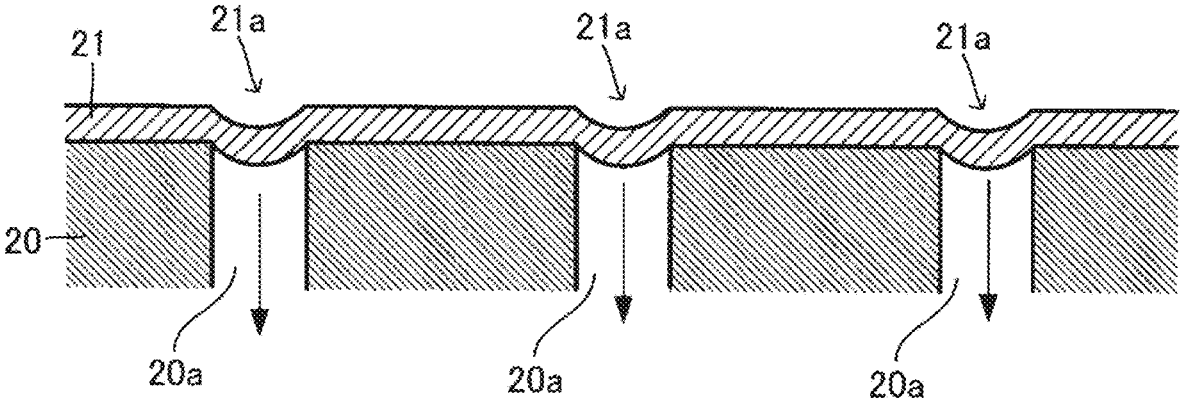
FIG. 5 is a diagram illustrating a process of preparing the anode catalyst layer 12.
Figure 6:
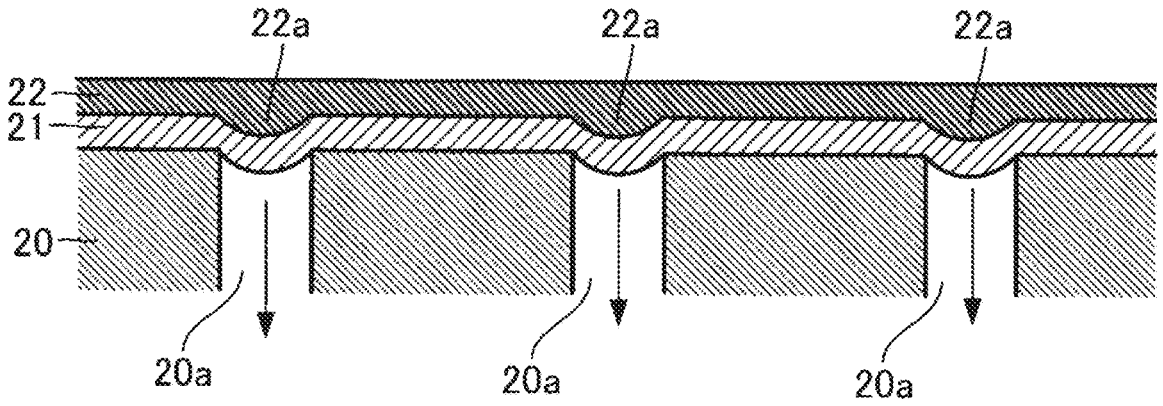
FIG. 6 is a diagram illustrating a process of preparing the anode catalyst layer 12.
Figure 7:
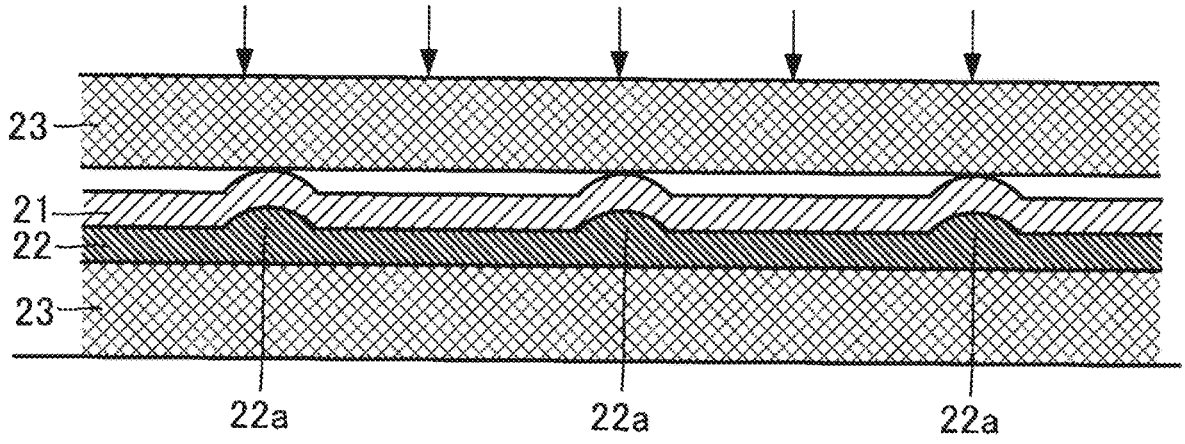
FIG. 7 is a diagram illustrating a process of preparing the anode catalyst layer 12.

As illustrated in FIG. 5, a backing sheet 21 (e.g., a Teflon (registered trademark) sheet) is placed on a fixing table 20 for applying the catalyst ink 22 (FIG. 6). The fixing table 20 is provided with a plurality of holes 20*a*. The holes 20*a* are provided at positions corresponding to the positions for forming the high density portions 12*a*. As indicated by straight arrows in FIG. 5, concave portions 21*a* are formed in the surface of the backing sheet 21 to which the catalyst ink 22 is to be applied, by suctioning the backing sheet 21 through the holes 20*a* using a pump. Thereafter, an applicator is used to apply the catalyst ink 22 onto the surface of the backing sheet 21 to form a layer of the catalyst ink 22. At this time, the surface of the layer of catalyst ink 22 is made to be flat, as illustrated in FIG. 6. Thus, convex portions 22*a* are formed in the applied catalyst ink 22, at the positions of the concave portions 21*a*. The catalyst ink 22 is dried in this state, and thereafter is sandwiched between plates 23 (stainless steel plates or the like) that are smooth, as illustrated in FIG. 7, whereby the convex portions 22*a* formed on the dried catalyst ink 22 are smoothed by hot pressing (heating and pressurizing) as indicated by straight arrows. Thus, the convex portions 22*a* are greatly compressed, and the density of the catalyst thereat increases, thereby forming the high density portions 12*a*. This forms the anode catalyst layer 12 that has portions with a high catalyst density and portions with a low catalyst density in an in-plane direction (direction of flow of water), as illustrated in FIGS. 3 and 4.

2.2. Preparation of Cathode Catalyst Layer

The cathode catalyst layer 15 is prepared, for example, as follows. A cathode catalyst, an ionomer, deionized water, and alcohol are weighed and mixed in a beaker. This solution is applied onto a backing sheet (e.g., a Teflon (registered trademark) sheet) and dried. The cathode catalyst layer 15 is thus obtained.

2.3. Preparation of Water Electrolysis Membrane Electrode Assembly

After disposing the anode catalyst layer 12 and the cathode catalyst layer 15 prepared above on front and rear sides of the solid polymer electrolyte membrane 11, the backing sheets are removed, and hot press treatment is performed. Thus, the solid polymer electrolyte membrane 11, the anode catalyst layer 12, and the cathode catalyst layer 15 are bonded, thereby obtaining the water electrolysis membrane electrode assembly.

2.4. Manufacturing of Water Electrolysis Cell

The anode gas diffusion layer 13, the cathode gas diffusion layer 16, the anode separator 14, and the cathode separator 17 are laminated on the front and rear of the obtained water electrolysis membrane electrode assembly, in accordance with the layer layout illustrated in FIG. 1, and pressed, thereby obtaining the water electrolysis cell.

2.5. Effects etc.

According to the manufacturing of the water electrolysis cell as described above, the high density portions 12*a* in the anode catalyst layer 12 can be formed particularly easily and efficiently, resulting in a water electrolysis cell that is highly producible. Also, instead of preparing the anode catalyst layer 12 using the catalyst ink 22 as described above, the anode catalyst layer can be similarly prepared by a printing method in which dry powder is mixed and compacted under heat, or a coating method such as inkjet printing.

3. Examples

A water electrolysis cell was manufactured in an Example, in which the above-described high density portions were formed in the anode catalyst layer. The water electrolysis cell according to the Example was compared with a related water electrolysis cell without the high density portions, manufactured as a Comparative Example.

3.1. Manufacturing of Water Electrolysis Cell According to Example 3.1.1. Preparation of Anode Catalyst Layer First, 48.0 g of an anode catalyst (iridium oxide catalyst (manufactured by Umicore)), 9.6 g of an ionomer having proton conductivity (manufactured by AGC Inc.), 36.0 g of deionized water, and alcohol (21.5 g of 1-propanol and 33.2 g of ethanol) were mixed in a beaker and dispersed using an ultrasonic homogenizer to obtain a catalyst ink 22.

As illustrated in FIG. 5, the backing sheet 21 (a Teflon (registered trademark) sheet) was placed on the fixing table 20 for applying the catalyst ink 22 (FIG. 6), and the backing sheet 21 was suctioned through the holes 20*a* provided in the fixing table 20 using a pump, thereby forming the concave portions 21*a* in the backing sheet 21 on which the catalyst ink 22 was to be applied. The holes 20*a* here were circular, with a diameter of 20 mm. The holes 20*a* were laid out in a staggered layout, as illustrated in FIG. 3. Intervals a (see FIG. 3) between the holes 20*a* adjacent to each other in the direction of flow of water was set to 15 mm, and a pitch $p_1$ (see FIG. 3), which is a center-to-center distance between the holes 20*a* adjacent to each other in the direction of flow of water, was set to 35 mm. A pitch $p_2$ (see FIG. 3) in a direction perpendicular to the direction of flow of water was also set to 35 mm.

Thereafter, the catalyst ink 22 was applied onto the backing sheet 21 using an applicator, so that the surface was made to be flat, as illustrated in FIG. 6. Thus, the convex portions 22*a* were formed in the applied catalyst ink 22, at the positions of the concave portions 21*a*. The catalyst ink 22 was dried at 85° C. for five minutes in this state, and thereafter was sandwiched between the plates 23 (stainless steel plates) that are smooth, as illustrated in FIG. 7, and hot-pressed at 130° C. for four minutes. Thus, the convex portions 22*a* formed on the dried catalyst ink 22 were smoothed. In this way, an anode catalyst layer was obtained in which the iridium oxide catalyst and the ionomer were mixed at a weight ratio of 1:0.2. In this anode catalyst layer, with the weight per unit volume of the low density portion as 1, the weight per unit volume of the high density portion was 1.24.

3.1.2. Preparation of Cathode Catalyst Layer

First, 6.1 g of a cathode catalyst (Pt-on-carbon (amount of Pt borne 18%, manufactured by Cataler Corporation)), 6.0 g of an ionomer having proton conductivity (manufactured by AGC Inc), 88.4 g of deionized water, and 45.2 g of alcohol (ethanol) were weighed, placed in a beaker, and dispersed using an ultrasonic homogenizer. This solution was applied onto a backing sheet (Teflon (registered trademark) sheet) having a thickness of 1.0 mm, and dried at 85° C. for five minutes. As a result, a cathode catalyst layer was obtained in which carbon and ionomer were mixed at a weight ratio of 1:1.2.

3.1.3. Preparation of Water Electrolysis Membrane Electrode Assembly

The anode catalyst layer and the cathode catalyst layer prepared above were disposed on the front and rear of a 15 μm thick solid polymer electrolyte membrane (manufactured by Gore Japan), following which the backing sheets were removed, and subjected to hot press treatment at 130° C. under 130 kPa for four minutes or more, thereby obtaining a water electrolysis membrane electrode assembly. Now, performing press treatment at a temperature higher than a softening point temperature of the ionomer yields an anode catalyst layer having a high density and a uniform thickness. Note that the area of the layer face of the water electrolysis membrane electrode assembly (the area that appears in plan view) was 300 $cm^2$.

3.1.4. Manufacturing of Water Electrolysis Cell

The anode gas diffusion layer (platinum-vapor-deposited titanium fiber), the cathode gas diffusion layer (carbon fiber), the anode separator, and the cathode separator were laminated on the front and rear of the obtained water electrolysis membrane electrode assembly, in accordance with the layer layout illustrated in FIG. 1, and pressed, thereby obtaining the water electrolysis cell.

3.2. Manufacturing of Water Electrolysis Cell According to Comparative Example

A water electrolysis cell was prepared in the same way as in the Example, except that a surface plate without holes was used instead of the fixing table used in preparing the anode catalyst layer according to the Example. Thus, a water electrolysis cell was obtained in which the density of the iridium oxide catalyst was uniform in the in-plane direction of the anode catalyst layer.

3.3. Evaluation test

The manufactured water electrolysis cells were evaluated as follows. A sufficient amount of pure water (<1 μS/cm) was circulated through the water inlet ports of the anode separator and the cathode separator, the temperature of the water electrolysis cell was 60° C., the applied voltage was adjusted such that the electrolysis current density was 2.5 $A/cm^2$, and water electrolysis was performed for 5 hours. Thereafter, a ratio of an electrolysis voltage $V_5$ five hours after, as to an electrolysis voltage $V_0$ immediately after starting the test ($V_5/V_0 \times 100\%$) was calculated as a water electrolysis activity maintenance factor.

3.4. Results

Figure 8A:
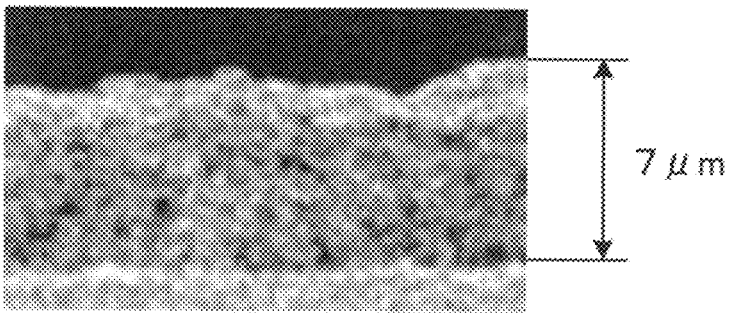
FIG. 8A is a diagram showing results of an Example.
Figure 8B:
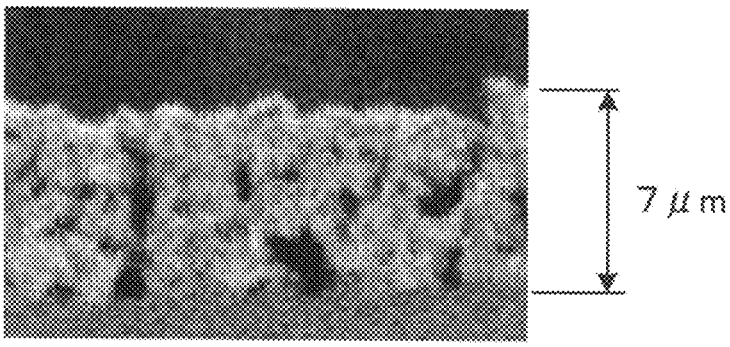
FIG. 8B is a diagram showing results of a Comparative Example.

FIGS. 8A and 8B show cross-sections of the anode catalyst layer of the manufactured water electrolysis cells. FIG. 8A is a cross-section of a high density portion of the anode catalyst layer in the water electrolysis cell according to the Example. FIG. 8B is a cross-section of the anode catalyst layer in the water electrolysis cell according to the Comparative Example. It can be seen from FIGS. 8A and 8B that the high density portion of the Example and the anode catalyst layer of the Comparative Example have the same thickness (7 μm), but the high density portion of the Example is dense as compared to the anode catalyst layer of the Comparative Example. Note that in the water electrolysis cell according to the Example, the portions other than the high density portions of the anode catalyst layer (low density portions) had the same cross-section as the anode catalyst layer according to the Comparative Example.

The water electrolysis activity maintenance factor of the water electrolysis cell according to the Example was 100.6%, and accordingly a high maintenance factor was obtained. Conversely, the water electrolysis activity maintenance factor of the Comparative Example was 97.7%, which was lower than that of the water electrolysis cell according to the Example.

What is claimed is:

1. A manufacturing method of a water electrolysis cell, the manufacturing method comprising:

placing a backing sheet on a fixing table provided with a plurality of holes;

forming concave portions on a surface of the backing sheet that are recessed into the holes, by suctioning the backing sheet through the holes;

applying a catalyst ink to the surface of the backing sheet to obtain a layer of the catalyst ink including convex portions made at positions of the concave portions; and sandwiching the layer between smooth plates and applying heat and pressure such that an anode catalyst layer or a cathode catalyst layer is obtained in which portions at which the convex portions are compressed become portions exhibiting a higher density of catalyst than other portions.

* * * * *